United States Patent [19]

Cox

[11] 4,067,112

[45] Jan. 10, 1978

[54] CUTTING GUIDE FOR CUSTOM MATS

[76] Inventor: Melvin L. Cox, 214 W. Randolph, Enid, Okla. 73701

[21] Appl. No.: 735,387

[22] Filed: Oct. 26, 1976

[51] Int. Cl.[2] ..... B43L 13/00
[52] U.S. Cl. ..... 33/76 R
[58] Field of Search ..... 33/76 R, 75, 32 R, 32 B, 33/32 C, 26, 79 R, 80, 81; 30/294, 293

[56] References Cited

U.S. PATENT DOCUMENTS

| | | | |
|---|---|---|---|
| 2,089,757 | 8/1937 | Nieuwkamp | 33/76 |
| 3,133,354 | 5/1964 | Irwin | 33/80 |
| 3,394,457 | 7/1968 | Holder | 33/32 C |

*Primary Examiner*—Harry N. Haroian
*Attorney, Agent, or Firm*—William R. Laney

[57] ABSTRACT

This device for cutting mats for pictures and picture frames, consists primarily of a hinged straight edge secured to another straight edge, the combination having adjustable scale means for accurately measuring and cutting mats.

5 Claims, 11 Drawing Figures

11
2
2
15
17
3
16
19
35
21
29
13
12
3
10
22
33
34
21
32
30
14
16
16
15
11

18
13
11
14a
14a 14
41
40
37
16

14
38
14
11
3
4
5
29
30
13
12
14

38
37a
41
40
37
36
11

39
40

CUTTING GUIDE FOR CUSTOM MATS

This invention relates to measuring instruments, and, more particularly, to a cutting guide for custom mats.

It is, therefore, the principal object of this invention to provide a cutting guide for custom mats, which will enable a person to quickly produce custom mats for pictures and picture frames.

Another object of this invention is to provide a device, of the type described, which will enable a person to accurately measure and cut a mat.

A further object of this invention is to provide a device, of the type described, which will be of such structure, so as to eliminate the measuring and marking of the inside dimensions of the mat.

An additional object of this invention is to provide a cutting guide for custom mats which enables an operator to quickly and accurately cut a rectangular opening inside a mat blank following calibration of the cutting guide to provide accurate removal of the interior of the mat blank with a variety of types of cutting devices.

Other objects of the invention are to provide a cutting guide for custom mats, which is simple in design, inexpensive to manufacture, rugged in construction, easy to use and efficient in operation.

These and other objects will readily evident upon a study of the following specification and the accompanying drawings, wherein.

Figures 1, 2, 3, 4:
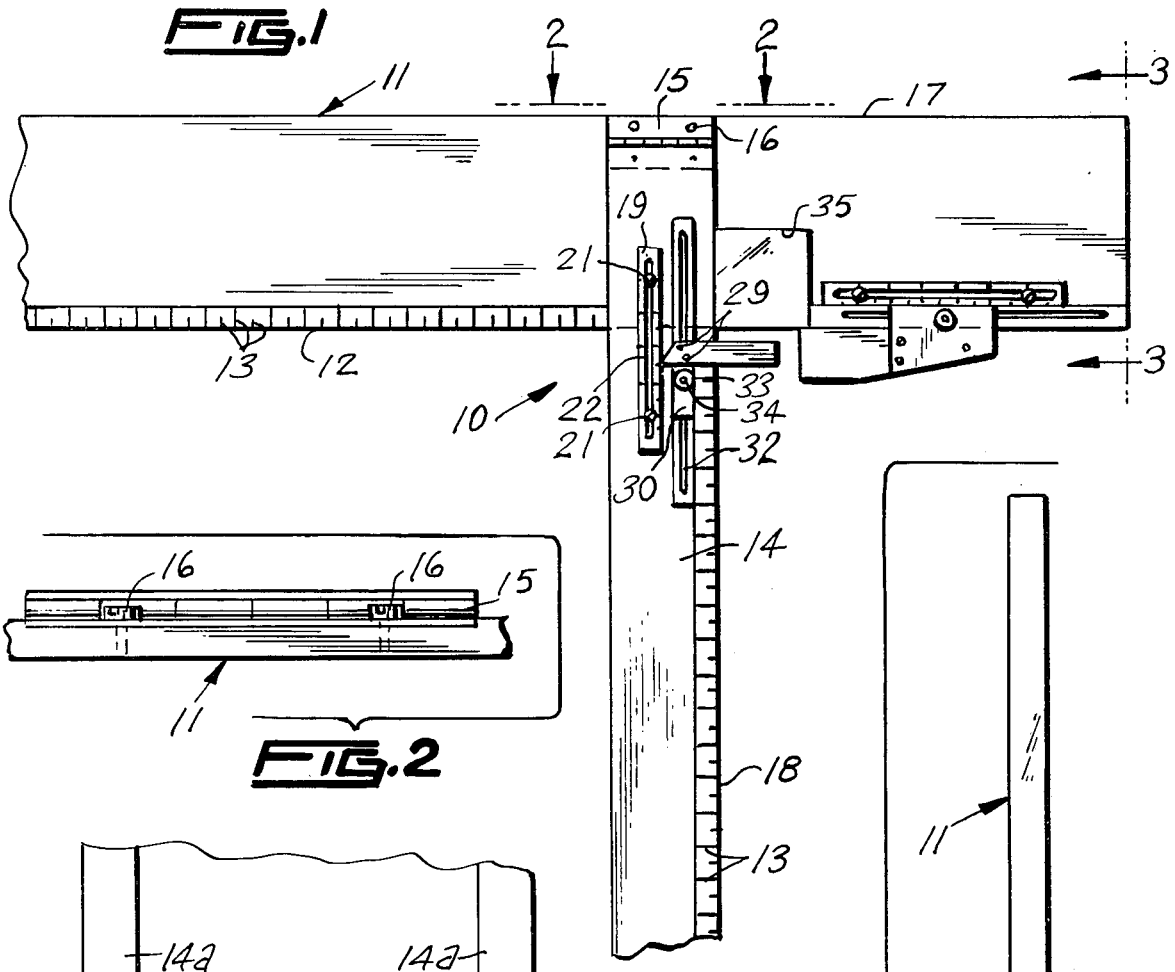
FIG. 1 is a top plan view of a cutting guide device, comprising the present invention.
FIG. 2 is an enlarged view, taken along the line 2—2 of FIG. 1.
FIG. 3 is an enlarged view, taken along the line 3—3 of FIG. 1.
FIG. 4 is a fragmentary, bottom plan view of the hinged vertical scale, shown removed from FIG. 1.
Figures 5, 6, 7, 8, 9A:
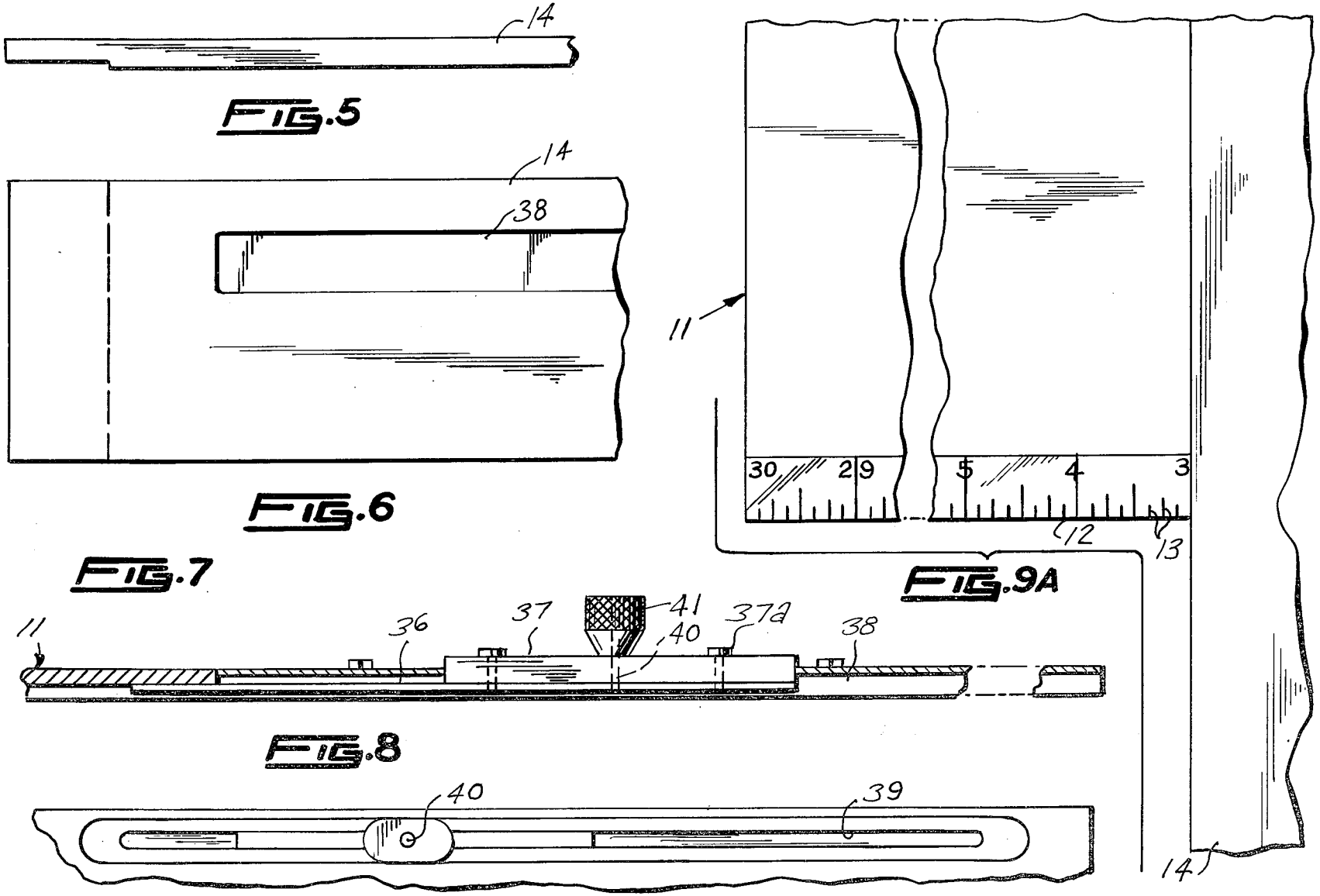
FIG. 5 is a side view of FIG. 4.
FIG. 6 is a fragmentary, top plan view of FIG. 4, shown without the attachments.
FIG. 7 is a fragmentary, front view of FIG. 1.
FIG. 8 is a bottom plan view of the top member of FIG. 7.
FIGS. 9 and 9A are fragmentary and composite views of FIG. 1, shown enlarged for the sake of clarity.

According to this invention, a cutting guide device 10 is shown to include an elongated and rectangular base 11, which forms one of the straight edges of device 10. One longitudinal side edge 12 of base 11 at the left, is provided with a plurality of numerically marked graduations 13. One of the outer edges of a mat blank to be cut using the device will always be flatly abutted against the longitudinal side edge 12, whether cutting an inside edge of the mat, or cutting an outside edge which extends normal to the outer edge thereof which is abutted against the side edge 12. The graduations 13 are used to measure off one of the outer side edge dimensions of the mat in a manner hereinafter described. A hinged scale member 14, forming a second straight edge, is secured fixedly at one end, to a hinge 15, by suitable fasteners 16, and similar fasteners 16 secure the opposite side of hinge 15, to base 11, at its longitudinal side edge 17. The longitudinal side edge 18, of hinged scale member 14, is provided with numerical graduations 13, similar to that of base 11. The longitudinal side edge 18 projects normal to the side edge 12 of base 11 and is used as a guide for a cutting knife device which is manually pushed along the side edge 18 during the cutting of the mat to selected and desired dimensions. Secured to hinged scale member 14 are a pair of spaced apart foam tape strips **14*a*, so as to hold the mat board in place while cutting after the mat board or blank is placed flat upon a table or other supporting surface under the scale member 14 with one outer side edge of the mat blank abutted against the side edge 12**.

An adjustable scale 19, having numerical graduations 20, is secured movably on scale 14, by means of screw fasteners 21, which are received freely within a longitudinally centered slot 22. The numerical graduations 20 on scale 19 indicate the distance which a knife blade cutting the mat will be from the edge 12 of base 11, and thus from the outer edge of the mat which abuts the base edge 12, at a time when the knife device housing from which the blade projects is stopped by contact with a bar 27 hereinafter described. Since the housings of different types of knife devices differ in their dimensions, and in the distances which they project around the actual cutting element, the susceptibility of the scale 19 to adjustment in the slot 22 toward and away from the edge 12 of the base 11 allows the cutting guide device to be calibrated to read accurately for different types of knife devices. A similar scale 23 with graduations 24 is secured movably on base 11, by means of screw fasteners 25, which are freely received in slot 26. The scale 23 performs a function similar to that of scale 19 in providing an indication, by the graduations 24 thereon, of the distance which will exist between the line of cut of the knife blade and the outer edge of the mat which extends parallel thereto. This edge of the mat is abutted against the edge of an adjustable stop plate hereinafter described, and extends perpendicular to the edge 12 of the base 11. Since the precise location at, toward or away from the longitudinal side edge 18 of hinged scale member 14 of the line of cut of a knife device moved therealong will vary with the type of knife device used, and also will depend upon whether the inside cut on the mat is to be beveled or not, slight adjustment of the scale 23 on the base 11 is often needed to calibrate to a particular knife device or angle of cut.

It shall be noted, that scales 19 and 23 are needed on device 11, so as to accommodate the variously manufactured cutting knives.

A pointer bar 27 having a point 28 is secured, by screw fasteners 29, to bar 30 which is slideable in bar 31, and an elongated slot 32 provides adjusting means for bar 27. A knurled knob 33 is received on fastener 34 which is freely received within slot 32, for a purpose which hereinafter will be described.

Figures 9, 10:
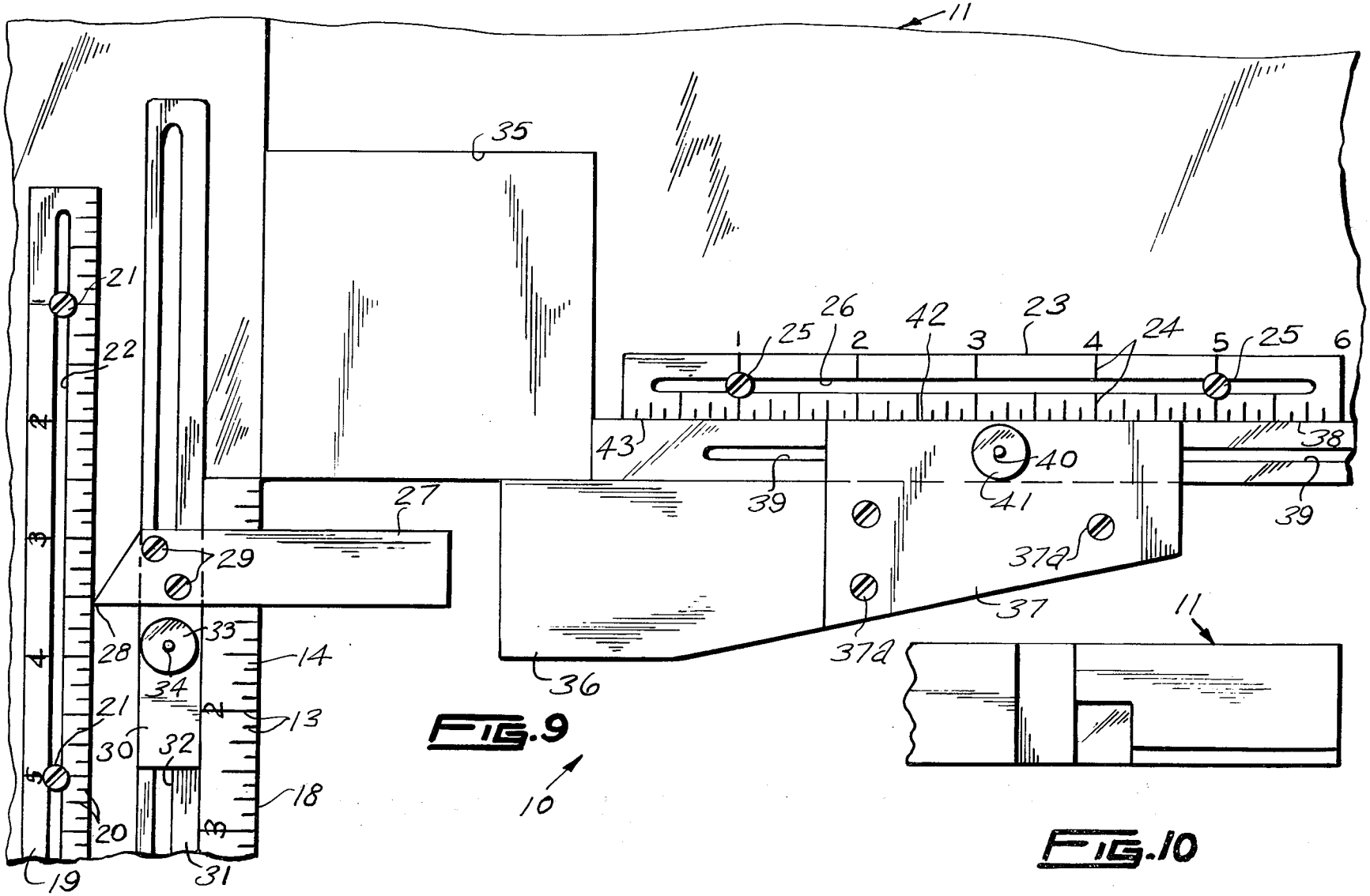
FIG. 10 is a fragmentary, right end view of the horizontal base plate of FIG. 1, shown without the attachments.

A routed out area 35 in base 11 serves as a means for receiving the front of a blade holder. This routed out area 35 is needed because when a cut of very small dimension is to be made in the mat blank, it is necessary that the pointer bar 27 and the bar 30 attached thereto be moved toward the base 11 until the point 28 is brought into line with such selected relatively small dimension as indicated on scale 19 (see FIG. 9). This requires that a space or relief be made in the base 11 in order to accommodate movement of the pointer bar 27 over the forward longitudinal edge 12 of the base 11. Thus, it can be seen that if a 2-inch border were to be formed around the mat by placing a cut line in the mat located 2 inches from the outer edge of the mat, the point 28, in being aligned with the numeral "2" on the scale 19, would place or position the pointer bar 27 over the routed out area 35, and this could be accomplished without interference which would otherwise be encountered from an unrelieved base member 11 at this point. It will be understood that in making the cut, the forward or leading edge of the knife housing in use bears against the pointer bar 27 at the time that the movement of the knife is stopped, and the knife blade per se will be displaced in a direction normal to the longitudinal edge 12 of the base 11 down the scale 31. The cut line will actually therefore be stopped the desired selected distance out into the mat blank — i.e., 2 inches. An adjustable stop plate 36, for a mat board, is secured fixedly to plate 37, by means of screw fasteners 37*a*. Base 11 includes a routed area 38, having an elongated slot 39, which freely receives screw fastener 40, which holds knurled knob 41. Edge 42 of plate 37 is in sliding engagement with edge 43 of base 11. The plate 37 terminates at one side in a straight edge 45 which extends normal to the longitudinal edge 12 of base 11, and also to the scale 23. As the plates 36 and 37 are slid along the longitudinal edge 12 of base 11, the straight edge 45 is variously aligned with the several graduations 24 on scale 23.

In use, the mat will not have to be measured and marked for the inside dimension before cutting. The above-mentioned is executed by simply setting pointed bar 27, and stop plate 36, to the desired inch markings on scales 19 and 23, respectively, after the scales have been calibrated for use of a particular knife or cutting device to be used.

While various changes may be made in the detail construction, it is understood that such changes will be within the spirit and scope of the present invention, as is defined by the appended claims.

What I claim is:

1. A cutting guide for producing custom mats comprising:

an elongated base having a straight longitudinal side edge for registering with one outside edge of a mat to be cut;

elongated scale means pivotally secured to said base and projecting normal to said straight longitudinal edge for guiding a knife device moved along said scale means in a direction perpendicular to said straight longitudinal edge of said base, and for indicating the length dimension of a cut made in said mat, and the location thereof in relation to said straight longitudinal edge and said one registering outside edge of said mat;

first adjustable stop means carried on said elongated scale means, and adjustably positioned along the length of said elongated scale means to selectively limit the distance a knife device can be moved along said scale member in a direction perpendicular to said straight longitudinal edge of said base;

second adjustable stop means secured to said base at a location along said longitudinal side edge and selectively positionable at varying distances from said scale means for locating a second outside edge of a mat extending perpendicular to said first-mentioned outside edge; and second scale means secured to said base and having graduations thereon visually correlatable with the position of said second adjustable stop means to indicate the dimension of the border of a mat formed by moving a knife device along said first-mentioned scale means in a direction perpendicular to said straight longitudinal edge of said base.

2. A cutting guide as defined in claim 1 and further characterized as including an adjustable scale movably mounted on said elongated scale means for adjustably cooperating with said adjustable stop means to indicate the distance a cut made by said knife device lies from the straight longitudinal edge of said base, and for calibrating the cutting guide for accurately indicating this distance when different types of knife devices are used to cut said mat.

3. A cutting guide as defined in claim 1 and further characterized as including an adjustable scale movably mounted on said base for adjustably cooperating with said second adjustable stop means to indicate the distance a cut made by said knife device lies from said second outside edge of said mat which extends perpendicular to said first-mentioned outside edge thereof, and for calibrating the cutting guide for accurately indicating said last-mentioned distance when different types of knife devices are used to cut said mat.

4. A cutting guide as defined in claim 1 and further characterized as including a plurality of numerical characters scribed on said base along at least a portion of said longitudinal side edge and defining distances of points along said longitudinal side edge from a side of said elongated scale means extending normal to said longitudinal side edge.

5. A cutting guide as defined in claim 1 wherein said base defines a routed out area aligned with said first adjustable stop means for receiving a portion of said first adjustable stop means in an adjusted position of said first adjustable stop means.

* * * * *

UNITED STATES PATENT OFFICE

CERTIFICATE OF CORRECTION

Patent No. 4,067,112 Dated January 10, 1978

Inventor(s) Melvin L. Cox

It is certified that error appears in the above-identified patent and that said Letters Patent are hereby corrected as shown below:

Column 3, after line 31, insert the attached.

Signed and Sealed this

*First* Day of *August 1978*

[SEAL]

*Attest:*

RUTH C. MASON
*Attesting Officer*

DONALD W. BANNER
*Commissioner of Patents and Trademarks*

Patent No. 4 067,112 January 10, 1978

Melvin L. Cox

Operation

In the operation and use of the cutting guide apparatus of the invention, a mat blank, consisting of a generally rectangular cardboard panel to be cut into a specifically sized mat, is initially placed flat upon a table or other supporting surface, with one longitudinal side edge thereof, preferably the length of the mat, abutted against the longitudinal side edge 12 of the rectangular base 11. An intersecting transverse side edge of the mat blank therefore projects perpendicularly to the longitudinal side edge 12, and, in positioning the mat blank, is abutted against the edge of the plate 36 which faces the scale 14

Prior to the time that the mat blank is so positioned preparatory to cutting the inside edges of the mat, the cutting guide device of the invention has been calibrated for the particular type of knife or cutting device which is going to be used. It will be understood that in cutting the mat to form the inside edges thereof, a cutting device, which carries at some location within a housing or holder a very sharp blade, will be abutted against the edge 18 of the hinged scale member 14 after the hinged scale member has been pivoted down to a position where it overlies the mat blank with the pads 14a on the underside thereof contacting and holding the mat blank in the described position.

Since the way in which the actual cutting edge of the knife blade carried in the cutting device or knife holder is located in reference to peripheral surrounding portions of the housing or holder varies from one cutting device to another, calibration of the cutting guide is needed in order to assure that measurements are made with respect to the line of cut through the mat blank actually established by the knife blade as it is moved with the holder. For example, the housing in which the knife blade is located may cause the knife blade itself to be spaced 1/4" to the right of the edge 18 of the hinged scale member 14, as this edge is viewed in Figure 9 of the drawings. In another device, the spacing of the blade from this edge may be 1/2". Since the scale 23 is utilized to provide an accurate indication of the distance which separates the edge of the mat blank which abuts the edge of the plate 36 from the formed inside edge of the finished mat, as established by the line of cut of the knife blade, it will be perceived that an adjustment in the location of the scale 23 is also needed to accommodate or allow for differences in the settings of the blades of various types of knife devices within their respective housings. This is accomplished by the adjustability of the scale 23 on the base 11, and such adjustment is made for a particular knife to be used prior to the time that actual cutting of the mat blank is carried out.

The same type of calibration is required in the use of the scale 19 which is provided for measuring the distance from that longitudinal edge of the mat blank which abuts the longitudinal edge 12 of base 11 to the point at which the line of cut made by the knife blade is terminated. This terminal point in this line of cut actually establishes the dimension of that border of the mat which is bounded by, and extends parallel to, its outside edge which abuts the edge 12 of the base 11.

With the device calibrated and the mat blank in cutting position as previously explained, the cutting device is initially placed along the edge 18 of the hinged scale member 14, and the knife blade is driven into and through the mat at a point along the numerical graduations 13 where the commencement of the line of cut is the desired distance inwardly from the outer edge of the mat. Thus, for example, if the outer edge of the mat blank which extends parallel to that outer edge abutting the longitudinal edge of base 11 extended beneath the mark indicating 20 inches in the graduations 13, and it were desired to form a two-inch border in the mat as cut, the knife blade would be penetrated through the mat at the location on the scale where 18 inches is indicated. Prior to starting the cut, the pointer bar 27 is adjusted so that its point 28 points to two inches on the adjustable scale 19. This will assure that when the cutting device strikes or comes into abutting contact with the bar 27, the line of cut will be stopped at a location which is two inches from the longitudinal edge of the mat blank which contacts the longitudinal edge 12 of the base 11.

Prior to commencing the cut, the plates 36 and 37 have also been adjusted in their positions along the base 11 to a point such that the side edge 45 is aligned with the two-inch graduation on the scale 23. This assures that the line of cut will lie two inches inside the side edge of the mat blank which abuts the facing edge of the plate 36 and extends perpendicular to the side edge 12 of the base 11. After this line of cut has been made, the mat blank is turned through 90 degrees and another line of cut is made which extends at 90 degrees to the first line of cut. The same method of assuring that a 2-inch border is formed is utilized in making this second line of cut. Finally, the procedure is repeated for making the last two lines of cut in the mat blank to remove the inside rectangular panel, and to leave a finished mat which includes a two-inch border or frame around an open interior.